US010415206B1

(12) United States Patent
Henry

(10) Patent No.: US 10,415,206 B1
(45) Date of Patent: Sep. 17, 2019

(54) BEAM AND BASE FOR SUPPORTING STRUCTURES

(71) Applicant: James Henry, Cary, IL (US)

(72) Inventor: James Henry, Cary, IL (US)

( * ) Notice: Subject to any disclaimer, the term of this patent is extended or adjusted under 35 U.S.C. 154(b) by 0 days.

(21) Appl. No.: 16/127,888

(22) Filed: Sep. 11, 2018

(51) Int. Cl.

| | |
|---|---|
| ***E04H 17/14*** | (2006.01) |
| ***E04H 17/22*** | (2006.01) |
| ***E02D 5/28*** | (2006.01) |
| ***E02D 5/52*** | (2006.01) |

(52) U.S. Cl.
CPC ..... *E02D 5/285* (2013.01); *E02D 5/523* (2013.01); *E04H 17/1421* (2013.01); *E04H 17/22* (2013.01); *E02D 2200/1621* (2013.01); *E02D 2200/1685* (2013.01); *E02D 2600/20* (2013.01)

(58) Field of Classification Search
CPC ..... E02D 5/285; E04H 12/22; E04H 17/14; E04H 17/1413; E04H 17/1417; E04H 17/1421; E04H 17/20; E04H 17/22
USPC ..... 404/10, 11; 248/519, 529, 533; 52/296, 52/297, 299, 1, DIG. 5, 65.02; 405/231, 405/249
See application file for complete search history.

(56) References Cited

U.S. PATENT DOCUMENTS

| | | | | |
|---|---|---|---|---|
| 203,099 | A * | 4/1878 | Simmerer | |
| 272,426 | A * | 2/1883 | Gray et al. | |
| 1,181,876 | A * | 5/1916 | Hall | E02D 5/72 405/253 |
| 1,637,627 | A * | 8/1927 | Wannamaker, Jr. | E02D 5/60 405/255 |
| 3,119,588 | A * | 1/1964 | Keats | E01F 13/02 116/173 |
| 3,282,001 | A * | 11/1966 | Bigalow | E04H 12/22 52/292 |
| 3,451,657 | A * | 6/1969 | Roberts | E04H 17/20 256/19 |
| 3,782,322 | A * | 1/1974 | Wilson | A63C 19/062 116/173 |
| 4,161,090 | A * | 7/1979 | Watts, Jr. | E04H 12/04 264/46.6 |
| 4,515,499 | A * | 5/1985 | Furiate | E01F 13/02 116/63 R |
| 6,367,224 | B1 * | 4/2002 | Leek | E04B 1/2604 403/187 |
| 7,066,094 | B2 * | 6/2006 | Moutsokapas | B66C 7/04 104/123 |
| 8,113,473 | B2 * | 2/2012 | Bradley | E04H 12/2253 174/158 F |
| 10,011,963 | B2 * | 7/2018 | Eaton | E01F 13/028 |
| 2015/0264890 | A1 * | 9/2015 | Barzani | A63K 3/046 119/502 |

* cited by examiner

*Primary Examiner* — Sunil Singh
(74) *Attorney, Agent, or Firm* — Vitale, Vickrey, Niro & Gasey

(57) ABSTRACT

The present disclosure relates to inventions which may improve the construction of structures of various sizes, including houses, porches, patios, and the like. The disclosed embodiments provide advantages over concrete foundations. For example, disclosed embodiments may provide a base and a beam which can replace a concrete foundation, thereby facilitating easier construction while maintaining required structural integrity. The base and beam may be formed of metal and coated in corrosion resistant plastic. Moreover, a cap may be attached to the beam, where the cap provides an interface for attaching a structural support beam.

6 Claims, 11 Drawing Sheets

BEAM AND BASE FOR SUPPORTING STRUCTURES

FIELD OF THE INVENTIONS

The present inventions relate generally to structural support devices, and more particularly, to apparatuses which may be used in place of concrete foundations to support structures of various sizes.

BACKGROUND OF THE INVENTIONS

The present invention relates generally to apparatuses and methods for supporting any above-ground structure, including without limitation homes, decks and patios. More specifically, the inventions relate to a metal pillar foundation which may support such a structure.

Presently, structures are supported with concrete foundations. However, concrete has several limitations that make it difficult and disadvantageous to use. For example, mixing, transporting, laying, and removing concrete requires a lot of man-power, even for smaller structures such as decks. Improper mixing or transporting of concrete can lead to a low quality or unusable product. Transporting concrete is particularly challenging in areas with limited accessibility. Removing also requires breaking the concrete and then disposing of all the pieces. Lastly, concrete can have a lasting and damaging impact on the environment. Therefore, it would be desirable to have an alternative to concrete that avoids its detrimental attributes.

Brief Summary of the Inventions

The present inventions overcome many of the disadvantages of concrete foundations used to support structures. For example, concrete foundations may be difficult and expensive to pour, especially in environments which are remote and/or difficult to access. Moreover, concrete foundations are difficult to remove or re-configure in the event that a structure is torn down, or expanded.

The present inventions generally provide a support structure, comprising a hollow beam having a top end and a bottom end; a circular base affixed to the bottom end of the hollow beam; and a cap having a protrusion, where the protrusion extends into the hollow beam to affix the cap to the top end of the beam; wherein the cap further comprises an elongated slot. Moreover, the protrusion may further comprises a pin hole configured to align with a pin hole in the hollow beam, and a pin may secure the cap to the beam. In some embodiments, the beam has a height of approximately 1.5 meters. Further, the base may have a radius of approximately 0.5 meters. Additionally, the base has four holes and is reinforced by concrete.

In some embodiments, the beam is unitarily formed with the base. The beam's bottom end may be threaded and the base may have a threaded hole, and the beam can be screwed in to the base to secure the beam to the base. In some embodiments, the beam and the base are buried beneath a ground's frost line and the cap extends above the ground's surface. Moreover, there may be a structural support beam which is secured to the beam by a bolt extending through the elongated slot.

Accordingly, it is an object of the present inventions to provide a structure which can replace a concrete foundation, which is easier to install and remove, and which may provide structural integrity equivalent to that of a concrete foundation.

DETAILED DESCRIPTION OF THE EMBODIMENTS

Figure 1B:
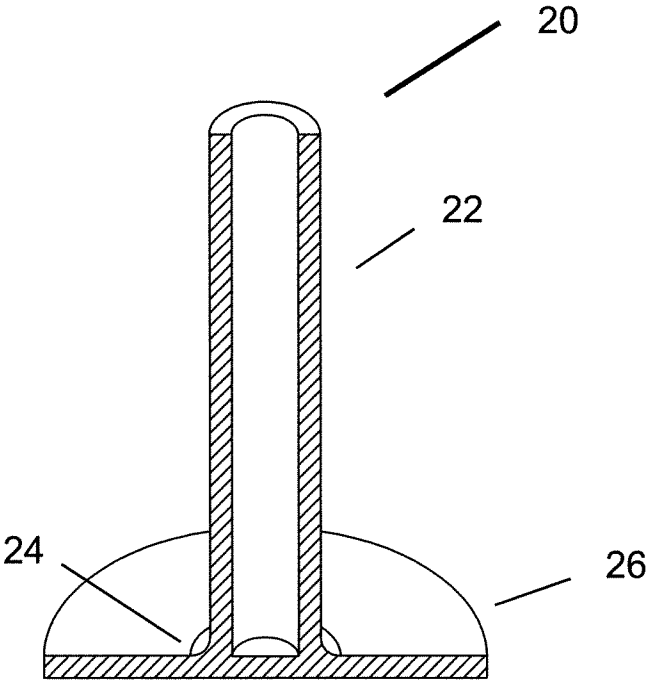
FIG. 1B illustrates a cross section of the metal pillar foundation with a hollow beam.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," supported," and "coupled" and variations thereof are used broadly and encompass both direct and indirect mountings, connections, supports and couplings. Further, "connected" and "coupled" are not restricted to physical or mechanical connections or couplings.

The following discussion is presented to enable a person skilled in the art to make and use embodiments of the invention. Various modifications to the illustrated embodiment will be readily apparent to those skilled in the art, and the generic principles herein can be applied to other embodiments and applications without departing from embodiments of the invention. Thus, embodiments of the invention are not intended to be limited to embodiments show but are to be accorded the widest scope consistent with the principles and features disclosed herein. The following detailed description is to be read with reference to the figures, in which the elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

The present disclosure is generally directed to a metal pillar foundation. While the apparatus of the present disclosure may be embodied in many different forms, several specific embodiments are discussed herein with the understanding that the present disclosure is to be considered only as an exemplification of the principles of the disclosure and is not intended to limit the disclosure to the embodiments illustrated.

Figure 1A:
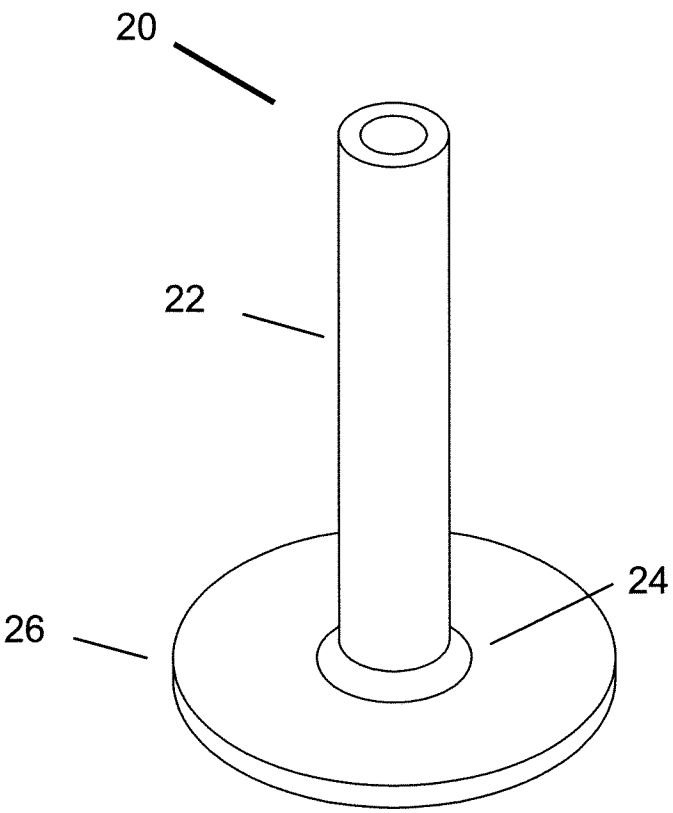
FIG. 1A is a perspective view of the metal pillar foundation with a hollow beam.
Figure 2B:
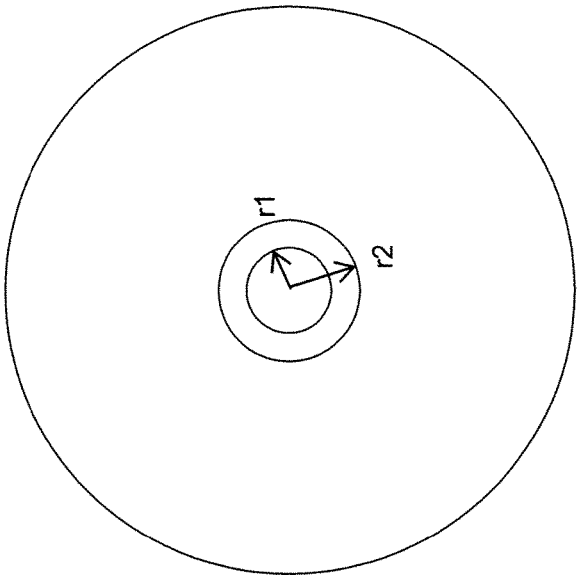
FIG. 2B illustrates a top view diagram of a metal pillar foundation, with a beam having an inner radius of r1 and an outer radius of r2.
Figure 2A:
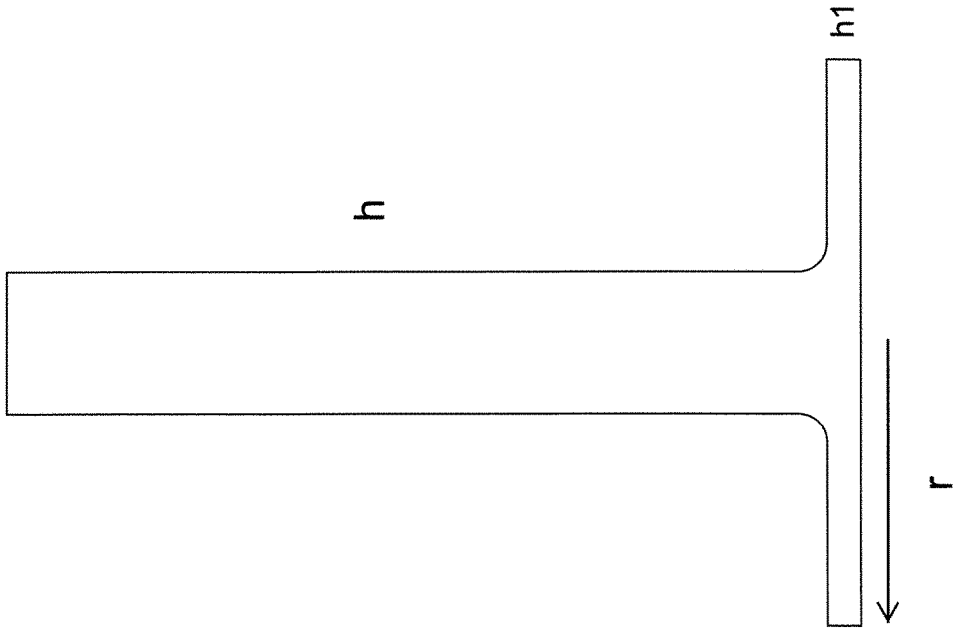
FIG. 2A is a diagram of a side view of a metal pillar foundation, with a beam of height h, a base of height h1 and radius r.
Figure 11:
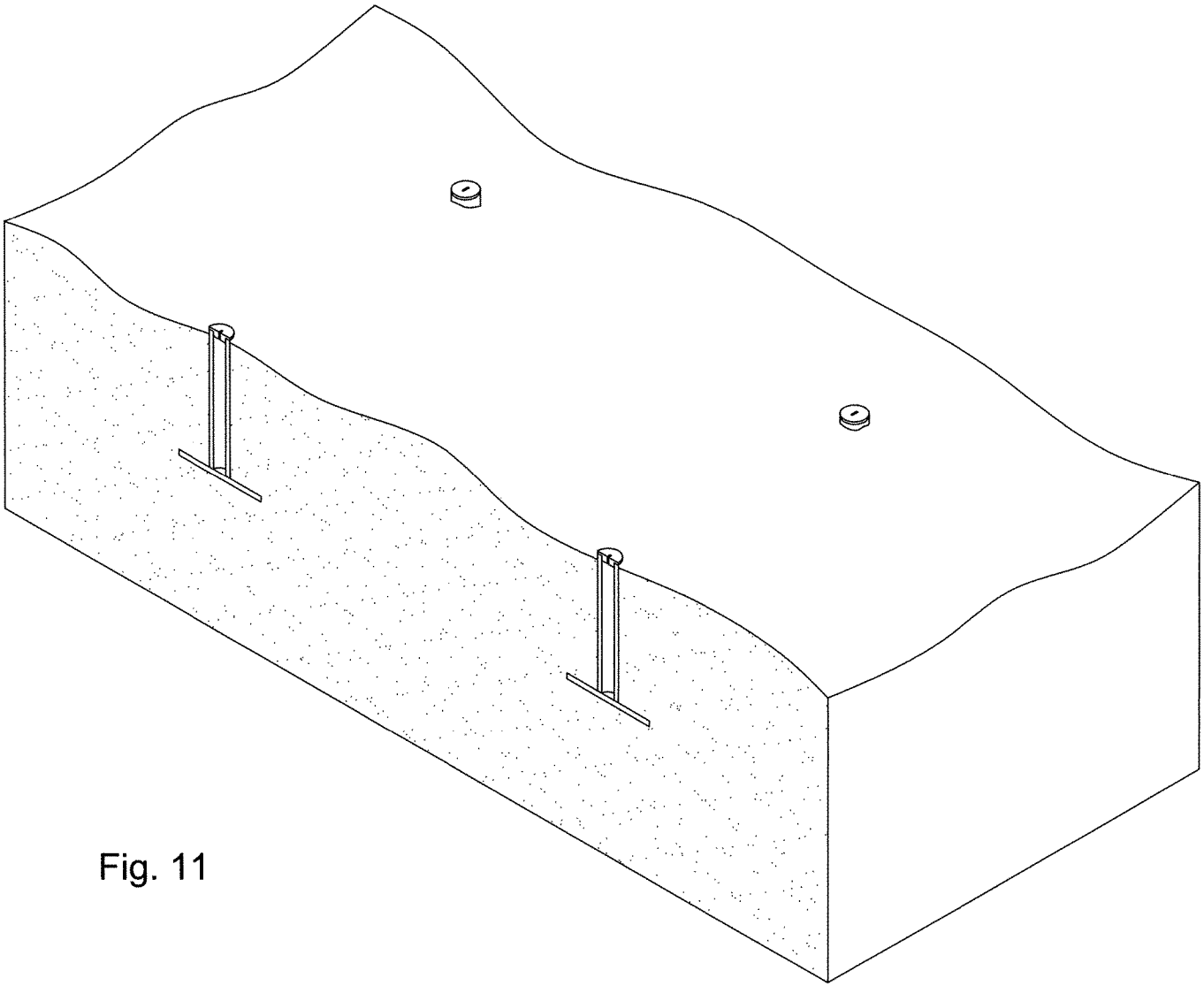
FIG. 11 shows a metal pillar foundation, with a cap, embedded in the soil.

The present disclosure relates generally to a metal pillar foundation which may be buried underground. (See FIG. 11, showing pillar foundation in the ground and below the frost line). Once buried, a structure may be built on top of, and attached to, the metal pillar foundation. In this way, the disclosed metal pillar foundation is used to secure a structure or building, thereby replacing the need for a concrete foundation. Referring to FIGS. 1A and 1B, an exemplary metal pillar foundation 20 is shown. The metal pillar foundation 20 may comprise a beam 22, and base 26, wherein the beam 22 and base 26 are connected by a connection 24. A cross-section of the beam 22 and base 26 is shown in FIG. 1B. The metal pillar foundation 20's beam 22 may have a height h, while the base 26 has a height h1 and a radius r. These dimensions are indicated in FIG. 2A. Likewise, the beam 22 may have an inner radius r1 and an outer radius r2, which are indicated in FIG. 2B.

The various dimensions may depend on the size of the structure and are adjusted to prevent the base from "bowing out." Bowing is an undesirable effect whereby the forces on beam 22 (e.g. the weight of the structure attached to the beam 22), act radially outward and against the base. That is to say, the weight of a structure attached to beam 22 may cause the bottom of beam 22 to experience a radially outward force, which (if not counteracted) would cause the beam to expand outwards and weaken. To counteract the bowing force, a base 26 of appropriate size and strength is necessary. By way of example, for large structures, the height of the base, h1, should be between 4.5-6 centimeters and the radius, r (indicated as the radius of the base, e.g. in FIG. 2), should be 0.5 meters. For smaller structures, such as wooden decks, the height of the base, h1, should be between 3 centimeters and the radius, r, could be 0.25 meters. For example, for some wooden decks or patios, a base radius may be approximately 12.5 cm. A person of skill in the art would recognize that varying the radius would result in a varied strength, and thus the radius should be size appropriately depending on the weight of the structure built.

FIG. 2 then provides dimensions for the beam 22 and base 26. In typical construction applications, the base 26 would be positioned below the frost line, which varies in depth depending on the geographical location. The height of the beam 12, h, must therefore exceed the depth of the frost line to ensure the base is below the frost line. For example, if the frost line approximately 1.2 meters deep, h should be 1.5 meters. In preferred embodiments, beam 22 may be hollow, with an inner radius, r1, and an outer radius, r2. A person of skill in the art would recognize that beam 22 does not necessarily have to be hollow, however, a hollow beam provides the advantages of saving on material costs and reduced weight. It is contemplated that various sizes may be provided, depending on the size and weight of a structure to be supported. In some embodiments, where beam 22 is used to support larger structures such as a house, inner radius, r1, may be between 9-10 centimeters in length. The outer radius, r2, may be 12.5 centimeters in length.

Figure 3B:
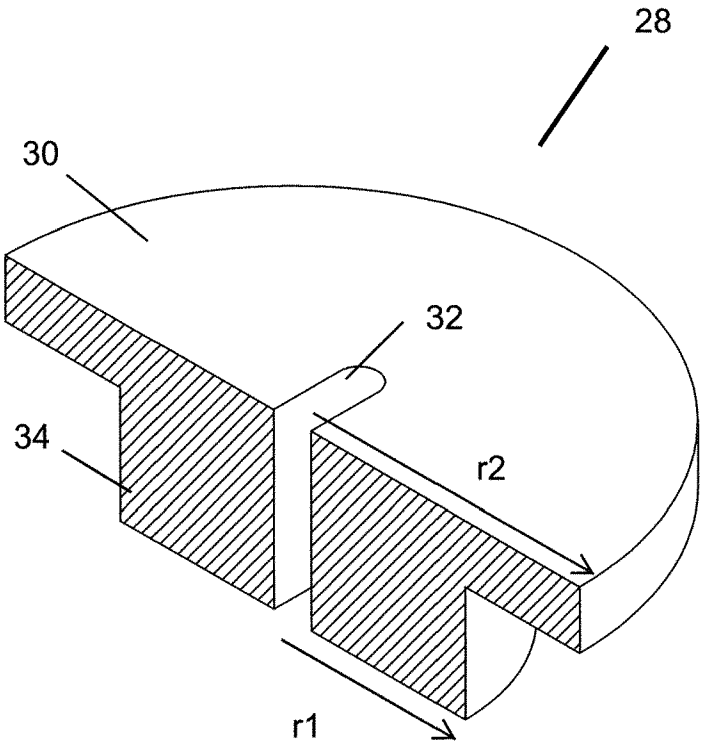
FIG. 3B is a cross section of a cap, with an inner radius of r1, and an outer radius of r2.
Figure 3A:
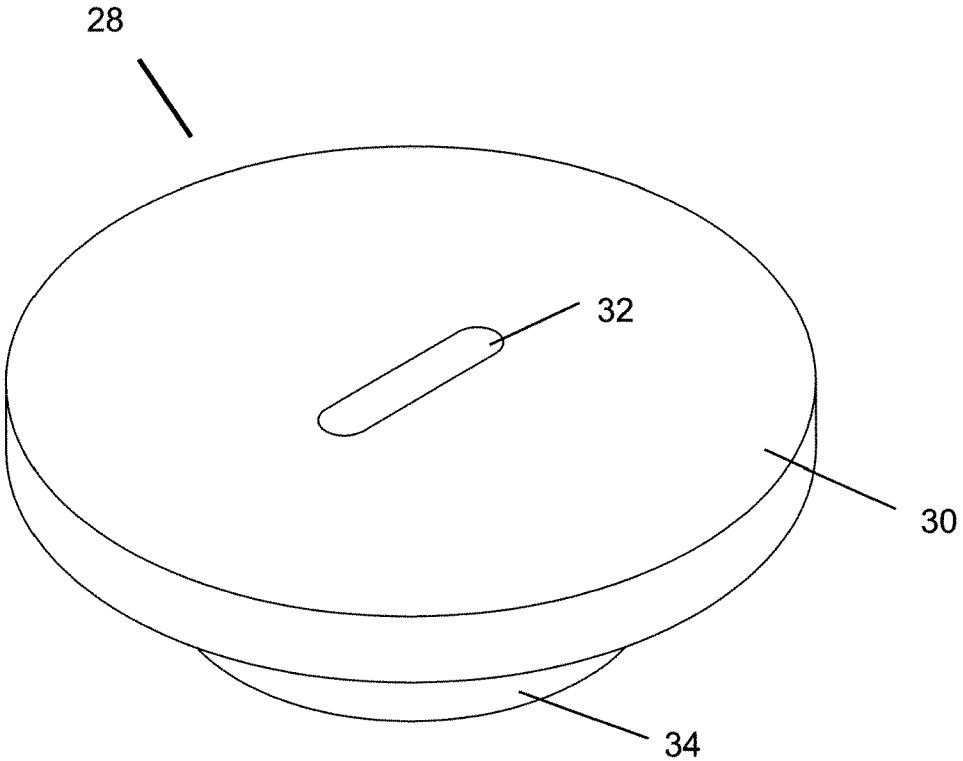
FIG. 3A is a perspective view of a cap, containing a slot for attaching a structure to the cap.
Figure 7:
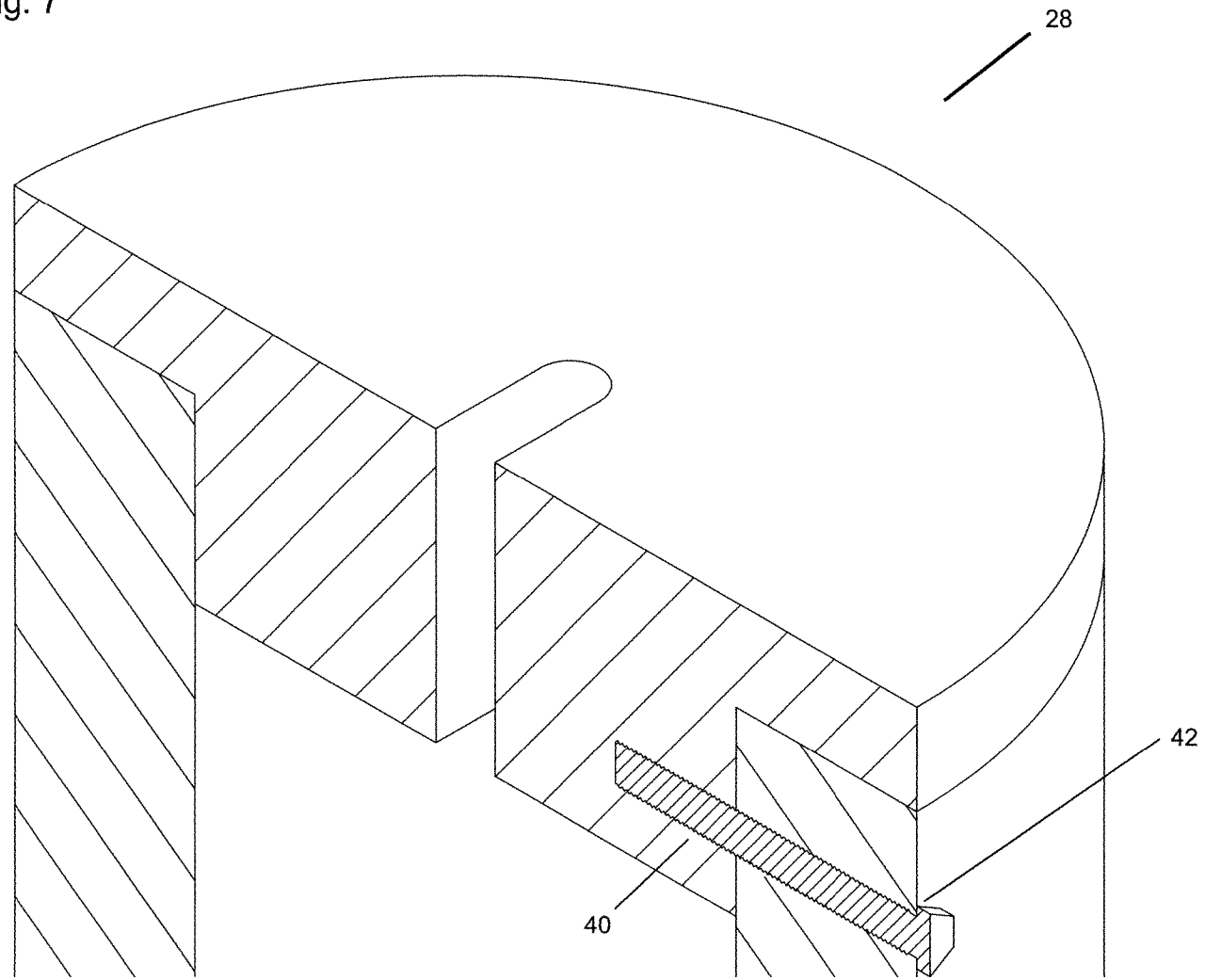
FIG. 7 is a cross-sectional view of an alternative embodiment where a cap is inserted into a metal pillar, and a pin is inserted into the hole in both the metal pillar and the cap, wherein the metal pillar is hollow.

To interface between the beam 22 and a structure to be supported, a cap 28 is provided. An example of a cap 28 is provided in FIG. 3A, and FIG. 3B shows a cross section thereof. The cap 28 may have a protrusion 34 which can be fitted for insertion at the top of beam 22, which is to say that the inner radius r1 of the cap 28's protrusion 34 matches the inner radius r1 of the beam 22. The protrusion 34 may further comprise a pinhole 40 (seen for example in FIG. 7) such that the cap 28 may be securely affixed to the beam 22. In embodiments shown in FIG. 7, the beam 22 has a slot 42 and the cap 28 has a slot 40 where a pin, such as a screw or bolt, can be inserted to keep the cap 28 from rotating. It should be understood that any known means for fastening may be used to secure the cap 28 to the beam 22.

Figure 9:
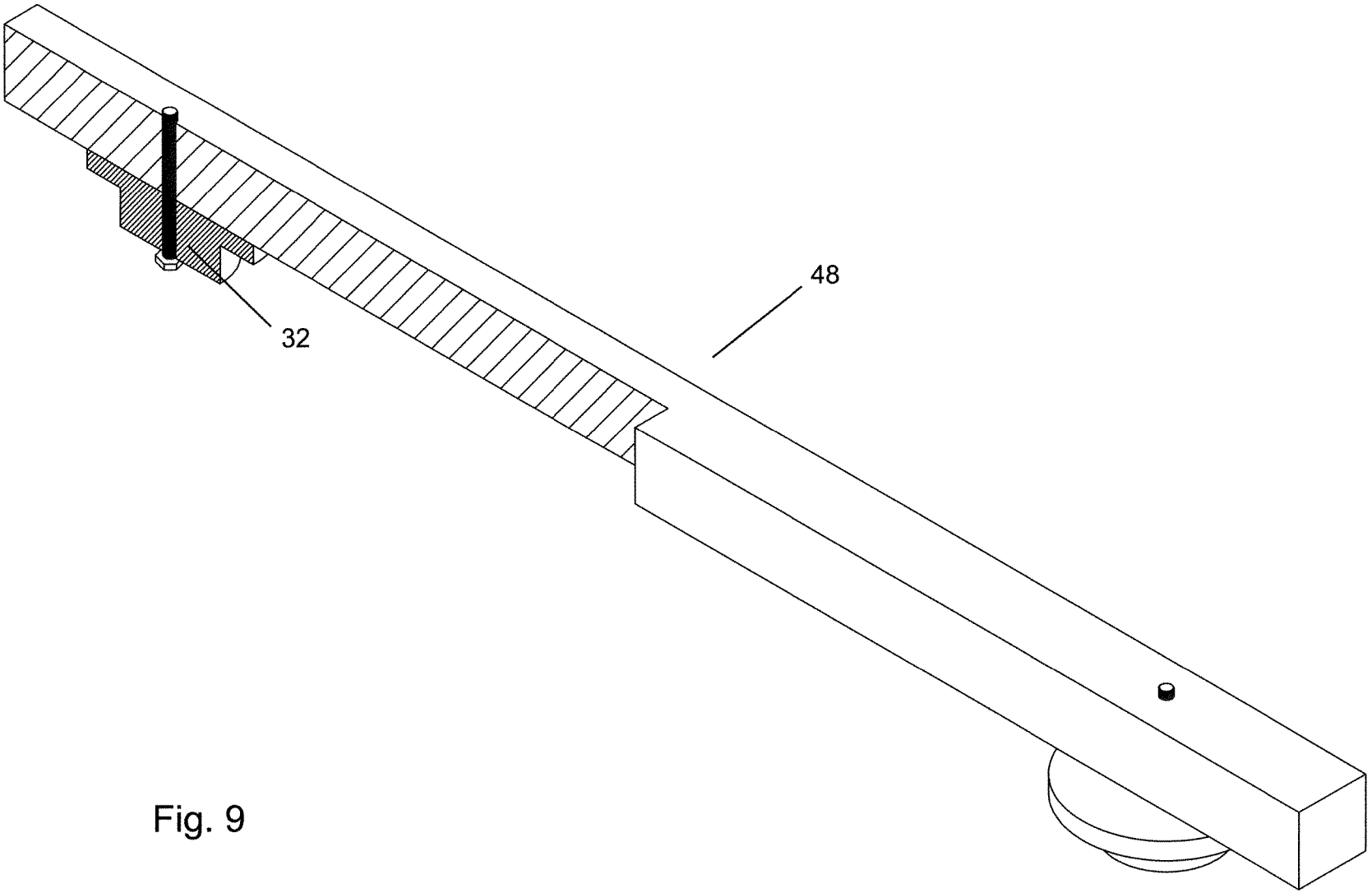
FIG. 9 illustrates a support beam attached to two caps using bolts.

As further seen in FIGS. 3A and 3B, cap 28 contains an elongated slot 32 through which a bolt may be attached to a structure. For example, a bolt can be inserted through slot 32 and affixed to a structure's cross-beam, thereby securing the structure to the cap 28, and by extension, to the beam 22. In other words, elongated slot 32 may receive a bolt which secures a structure to the cap 28 and by extension to the beam 22. Such an example is shown in FIG. 9 where a structural support 48 is seen bolted through an elongated slot (32) and thus secured to the cap 28 and beam 22.

Figure 4:
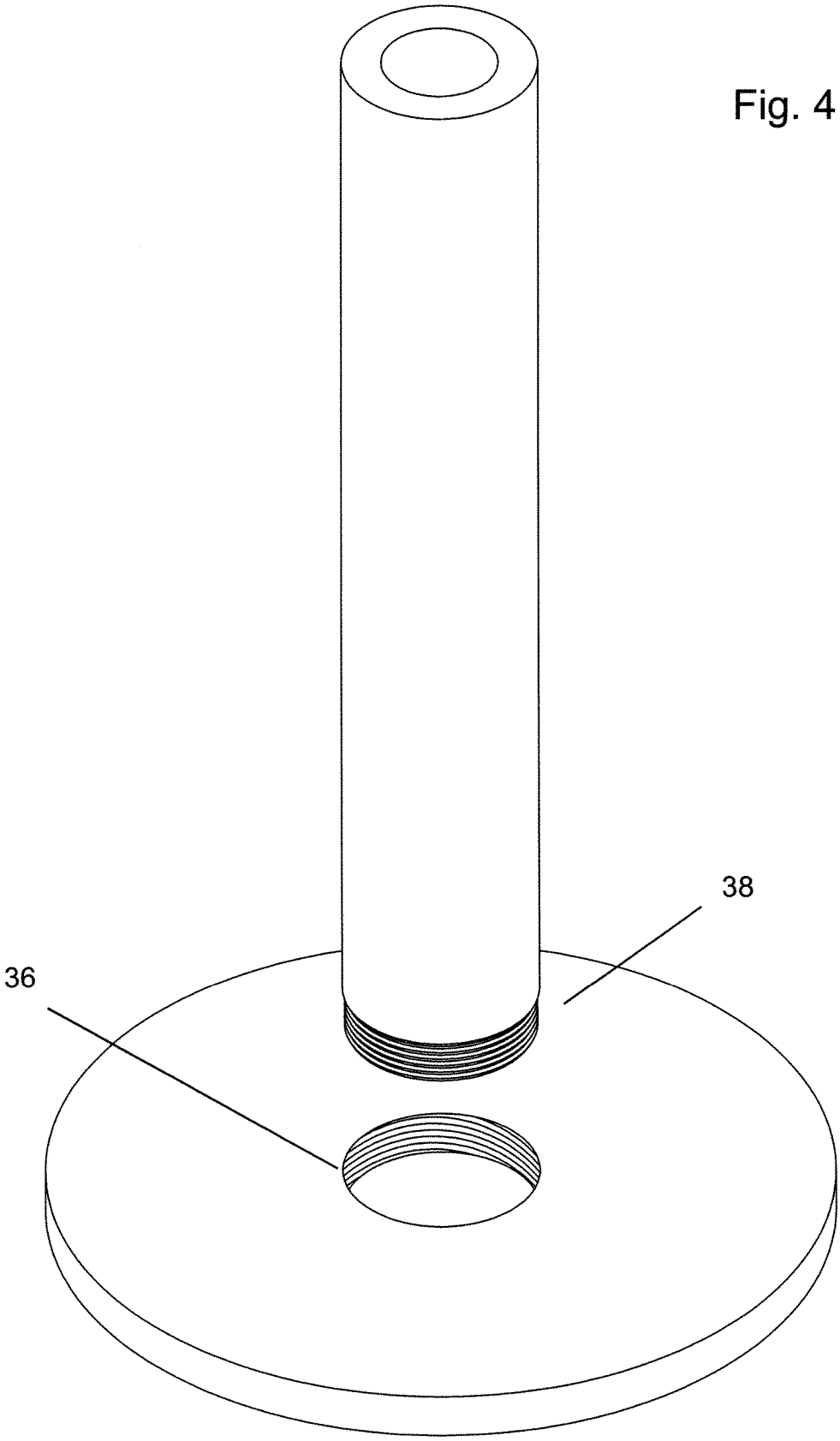
FIG. 4 is a perspective view of an alternative embodiment where a metal pillar has ridges and a hollow beam.
Figure 5:
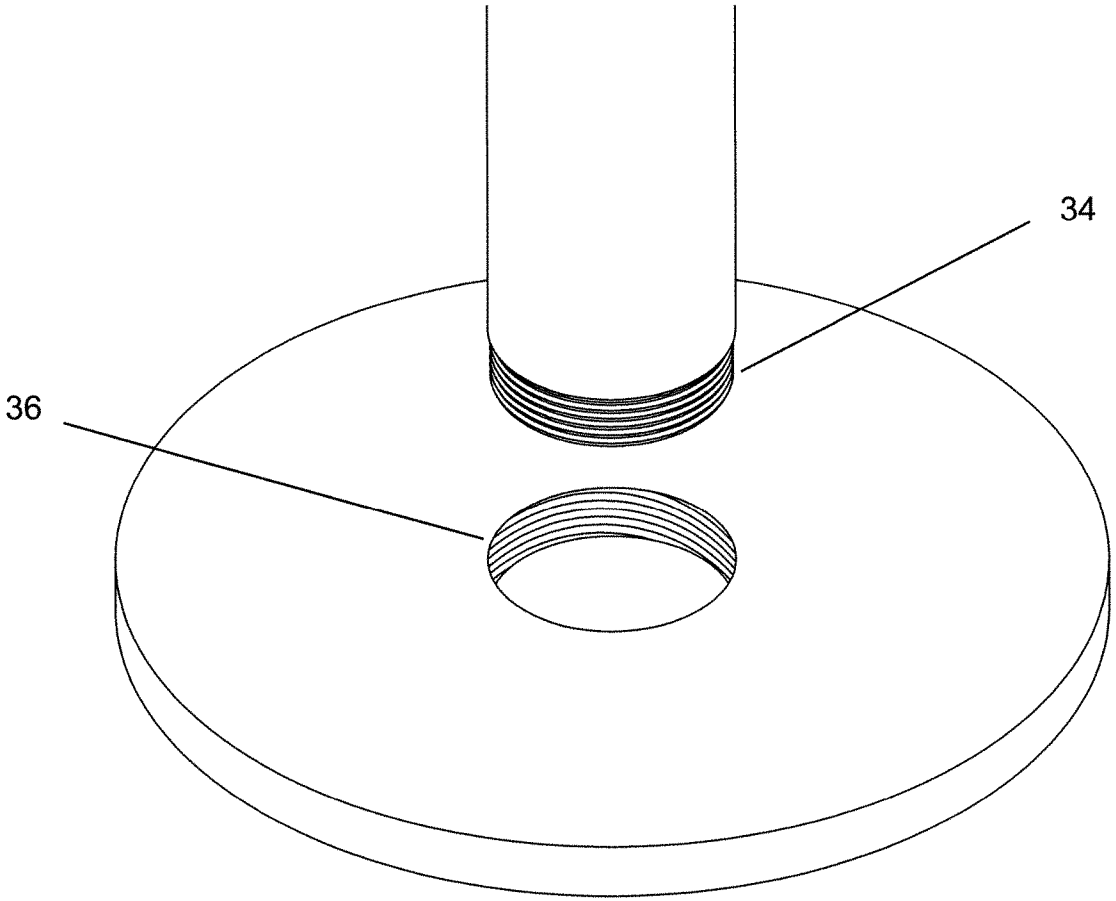
FIG. 5 illustrates an enlarged perspective view of an alternative embodiment where a metal pillar has threads on one end.
Figure 6:
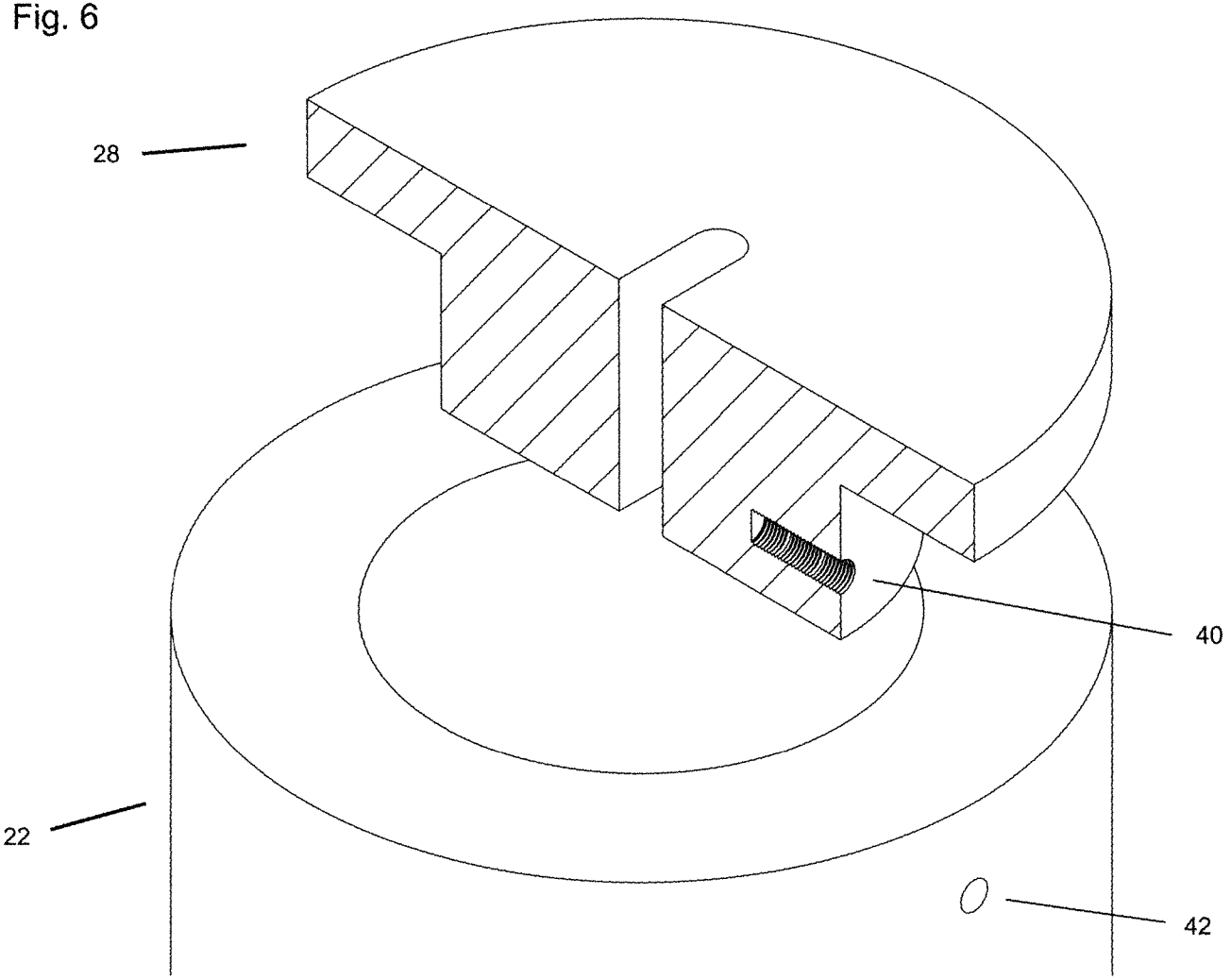
FIG. 6 illustrates an alternative embodiment where a has a threaded slot which aligns with a hole in a metal pillar.

In FIG. 4 and FIG. 5, the beam 22 and base 26 are manufactured as separate units, allowing each piece to be manufactured in various sizes and shapes, and from various materials. In this embodiment, the beam 22 is threaded at one end 38 and the base 26 has a threaded hole 36 in the center. The beam 22 and base 26 of FIGS. 4-5 may be connected by screwing the ridged beam 38 into the base's threaded hole 36, thereby securing the two components in place. Alternative mechanisms can be used to connect the beam 22 and base 26 and secure them. It is also possible to unitarily form beam 22 and base 26, which may provided the advantage of being stronger.

Figure 8C:
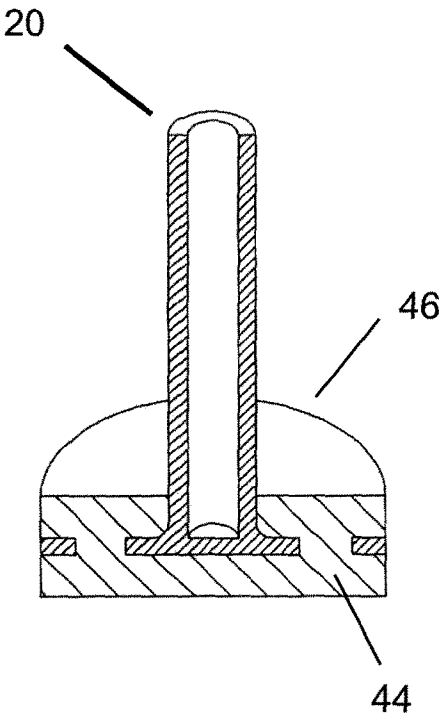
FIG. 8C is a cross sectional view of a metal pillar foundation with a plurality of holes, reinforced with concrete above and below the base.
Figure 8B:
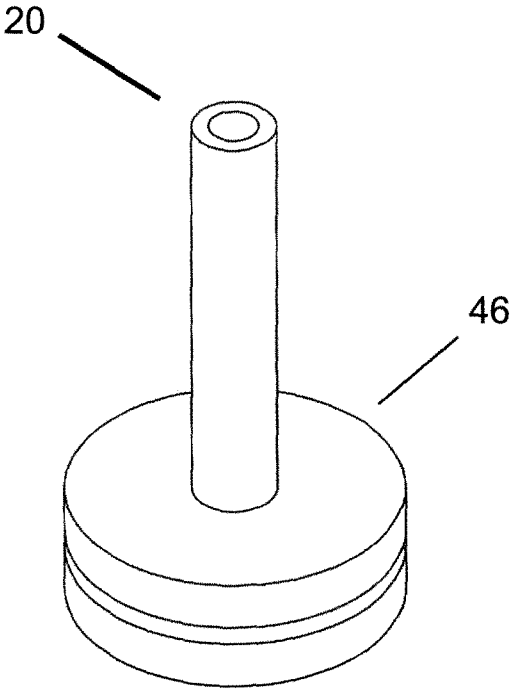
FIG. 8B is a perspective view of a metal pillar foundation with a plurality of holes in the base, reinforced with concrete above and below the base.
Figure 8A:
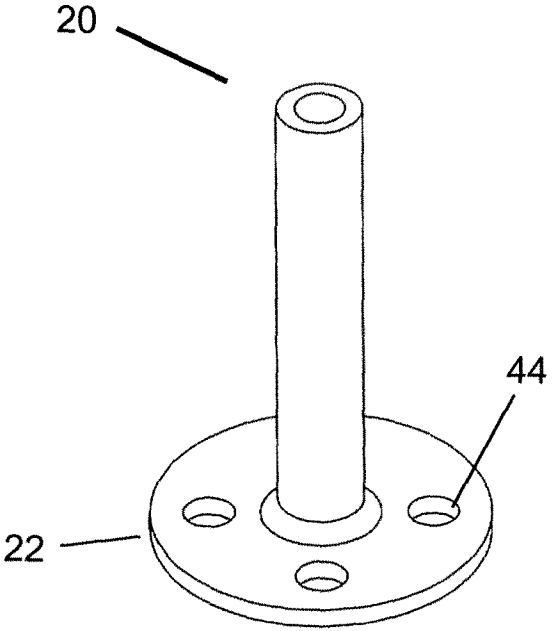
FIG. 8A is a perspective view of a metal pillar foundation having a plurality of holes in the base.

Additional embodiments of the inventions are disclosed in FIGS. 8A-8C. For example, FIG. 8A represents an embodiment for the pillar foundation 20 having a base 26, with holes 44. The holes 44 of FIG. 8A allow the base 26 to be reinforced with concrete for additional strength. An example of such concrete reinforcement is shown in FIG. 8B, where concrete 46 surrounds the base 26. In such an embodiment, the holes 44 serve to secure the concrete to the base 26. This is because the concrete may pass through the holes and thus form around the base 26. In this way, the presence of holes 44 allows concrete for surround the upper and lower surface and form around the base, which increases the strength. In the embodiments shown herein, at least four holes 44 may be used. However, a person of skill in the art would recognize that the objective or using concrete to reinforce strength may be accomplished with any number of holes having various shapes and sizes. FIG. 8C illustrates a cross section of the metal pillar foundation 20 with the base 26 reinforced with concrete 46.

Figure 10:
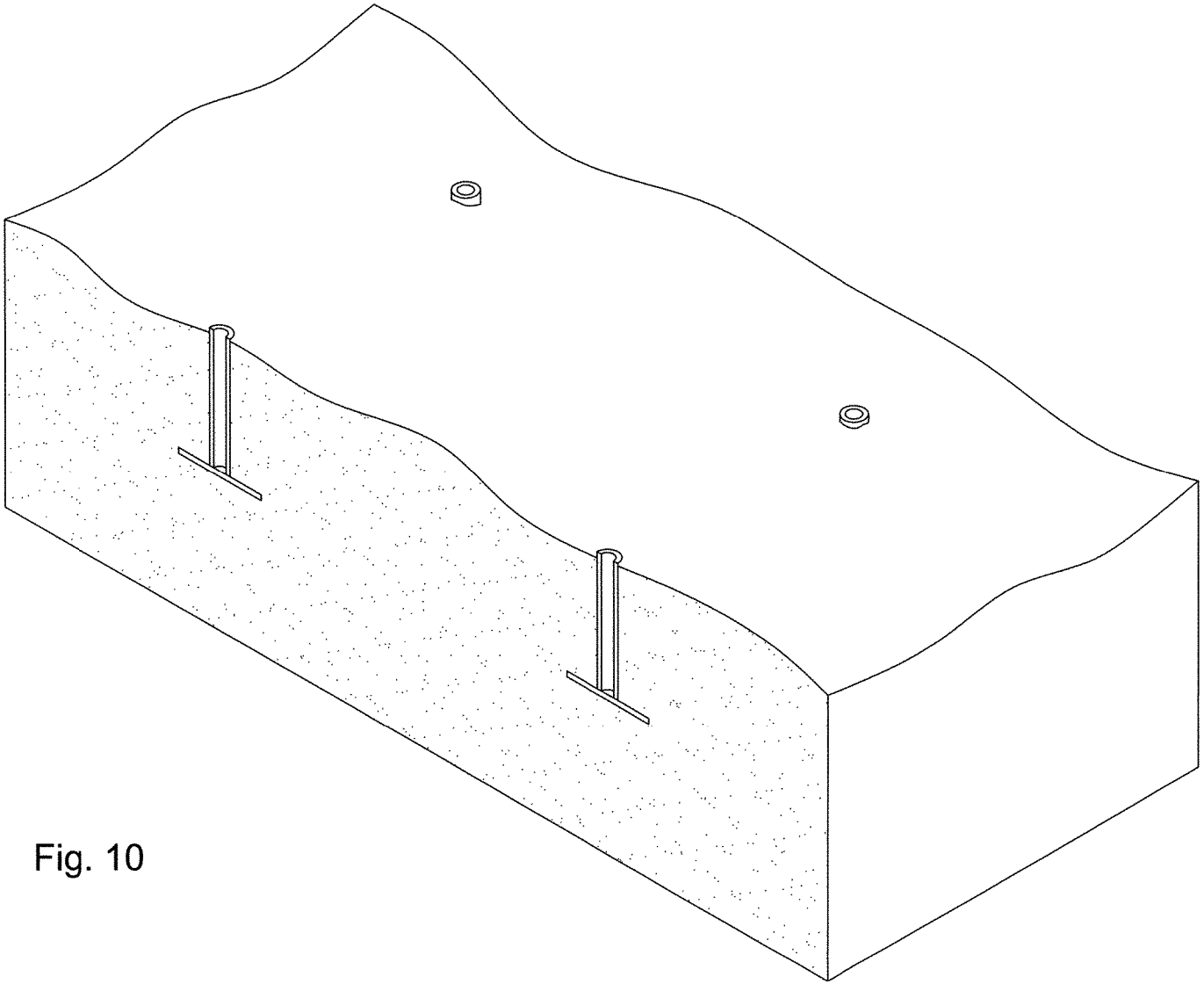
FIG. 10 shows a metal pillar foundation embedded in soil.

FIG. 10 and FIG. 11 represent an example of a foundation 20 placed in the ground, with and without the cap 28, respectively. That is to say, in FIG. 10, foundation 20 is seen without the above described cap 28 attached to the beam, whereas FIG. 11 shows a foundation with a cap 28 attached.

The positioning and spacing between the metal pillar foundations are calculated using known methods to properly determine the required support for the desired structure.

Reference is made in this disclosure stating that the foundation 20 may be metallic. A person of skill in the art would understand that desirable properties include a metal which has high strength and which is also resistant to corrosion. A metal having increase resistant to corrosion will provide for increased longevity. Examples of suitable metals include aluminum, as well as stainless steels. In one example, the stainless steel referred to as "304 SS" may be used to form the foundation 20, as well as other components such as the base 26. In embodiments of the invention, metal components may be dipped in plastic—such as products offered by Plasti Dip—to provide a plastic coating which increases resistance to corrosion. A layer of plastic coating would protect the metal from oxidizing and losing structural integrity.

The above description is not intended to limit the meaning of the words used in or the scope of the following claims that define the invention. Rather the descriptions and illustrations have been provided to aid in understanding the various embodiments. It is contemplated that future modifications in structure, function or result will exist that are not substantial changes and that all such insubstantial changes in what is claims are intended to covered by the claims. Thus, while preferred embodiments of the present inventions have been illustrated and described, one of skill in the art will understand that numerous changes and modifications can be made without departing from the claimed invention. In addition, although the term "claimed invention" or "present invention" is sometimes used herein in the singular, it will be understood that there are a plurality of inventions as described and claimed.

What is claimed is:

1. A support structure, comprising:

a hollow beam having a top end and a bottom end; wherein the hollow beam is made of stainless steel or aluminum and has a height of at least 1.5 meters;

a circular base affixed to the bottom end of the hollow beam;

a cap having a protrusion, where the protrusion extends into the hollow beam to affix the cap to the top end of the beam; wherein the cap further comprises an elongated slot; and a cross-beam secured to the elongated slot of the cap by a bolt;

wherein the circular base is buried beneath the frost line of the ground, the hollow beam extends from the base to the ground's surface, and the cross-beam is aboveground.

2. The support structure of claim 1, wherein the protrusion further comprises a pin hole configured to align with a pin hole in the hollow beam, and a pin secures the cap to the beam.

3. The support structure of claim 1, wherein the base has a radius of approximately 0.5 meters.

4. The support structure of claim 1, wherein the base has four holes and is reinforced by concrete, and the concrete surrounds the base.

5. The support structure of claim 1, wherein the beam is unitarily formed with the base.

6. The support structure of claim 1, wherein the beam's bottom end is threaded and the base has a threaded hole, and the beam is screwed in to the base to secure the beam to the base.

* * * * *